United States Patent [19]

Matthews

[11] 3,995,904

[45] Dec. 7, 1976

[54] CLAMP

[76] Inventor: Joseph E. Matthews, 4017 N. Witchduck, Virginia Beach, Va. 23455

[22] Filed: June 24, 1975

[21] Appl. No.: 589,840

[52] U.S. Cl. ..... 294/104; 294/86 R

[51] Int. Cl.[2] ..... B66C 1/44

[58] Field of Search ..... 294/104, 101, 86 R, 294/91, 92, 102, 103, 111, 112, 15; 24/269 FN, 268 LL, 263 LL, 263 DJ

[56] References Cited

UNITED STATES PATENTS

| | | | |
|---|---|---|---|
| 2,851,300 | 9/1958 | Thayer, Jr. | 294/104 |
| 3,162,476 | 12/1964 | Renfrop | 294/104 |
| 3,333,883 | 8/1967 | Kikachi | 294/104 |
| 3,834,751 | 9/1974 | Brockin | 294/104 |

*Primary Examiner*—James B. Marbert

*Attorney, Agent, or Firm*—Sughrue, Rothwell, Mion, Zinn and Macpeak

[57] ABSTRACT

A lift clamp for handling of objects such as I beams has an elongated lift arm with a fixed jaw projecting therefrom. A compression lever is pivotally mounted on the lift arm and has a jaw which is movable to a clamping position against the fixed jaw. A whip wire extends through a shackle on the lift arm and is secured to the compression lever. A tag line is secured also to the lever to release the clamp. In some environments of use, a spring is provided between the lift arm and the compression lever to urge the movable jaw against the fixed jaw.

5 Claims, 9 Drawing Figures

FIG. 1
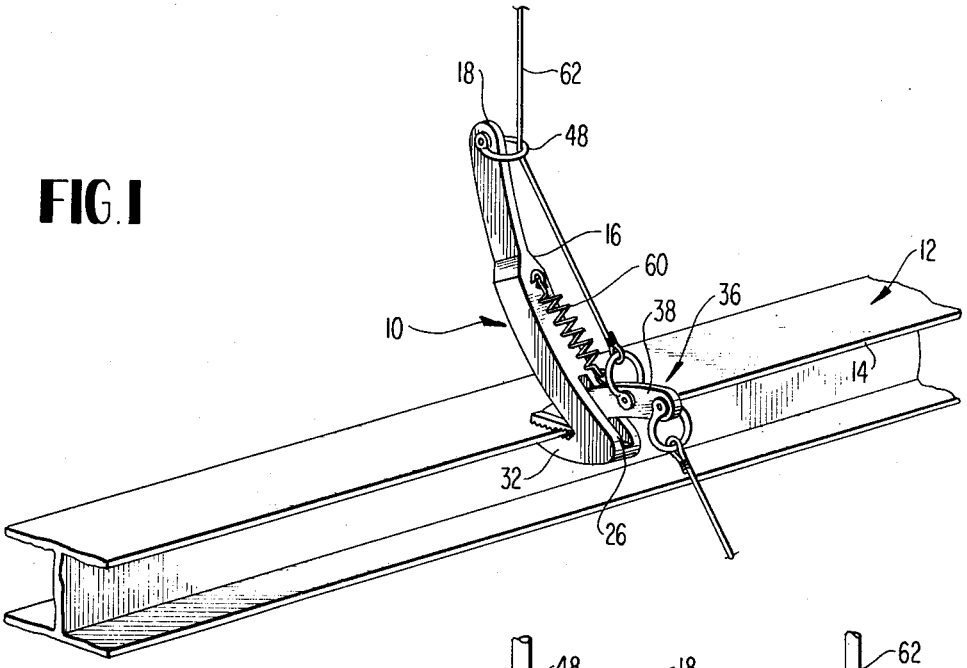
FIG. 2
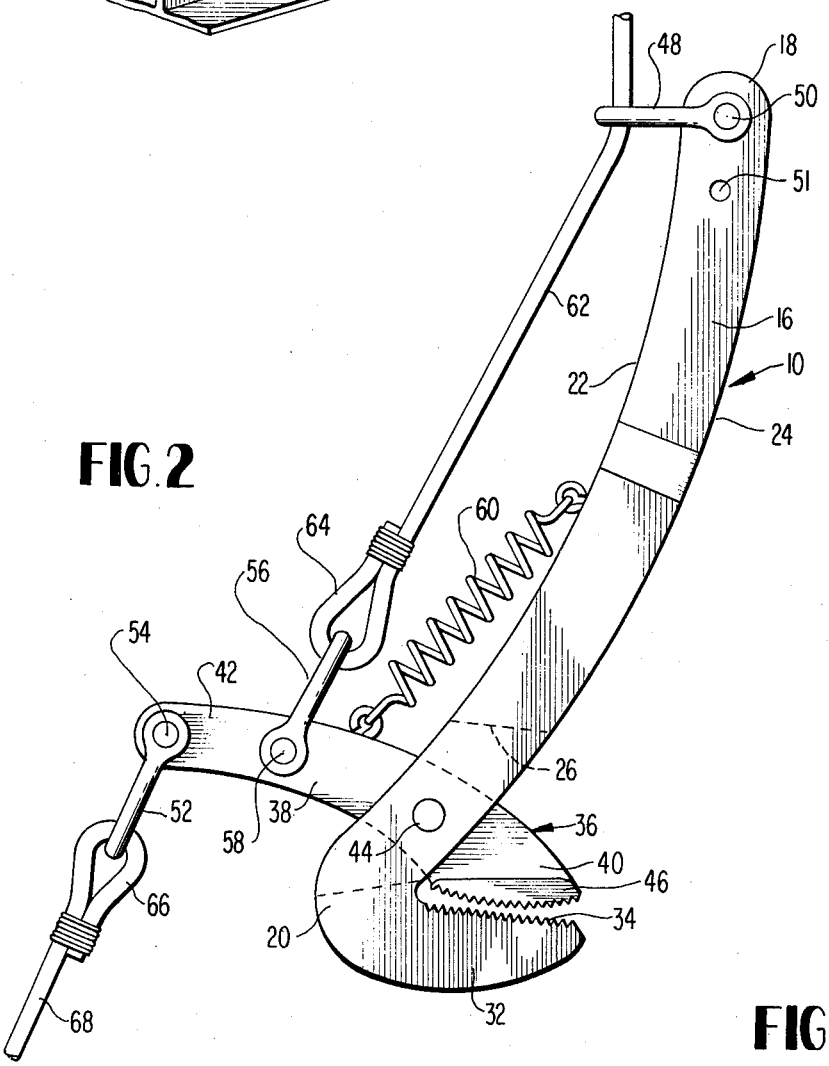
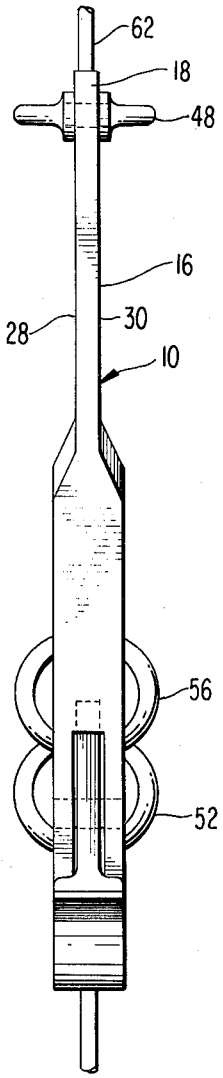
FIG. 3

CLAMP

BACKGROUND OF THE INVENTION

1. Field of the Invention

This invention relates to a lift clamp employed in the handling of objects such as I beams, and the like.

2. Description of the Prior Art

Release hooks of various designs for handling specialized articles have been heretofore proposed. Representative of such prior proposals are the devices shown in the following patents:

| Patent No. | Patentee | Issued |
|---|---|---|
| 2,937,541 | Barlow | May 24, 1960 |
| 2,667,376 | Schlachter | Jan 26, 1954 |
| 2,595,450 | Coffing | May 6, 1952 |
| 1,777,119 | Homoly | Sep 3, 1930 |
| 1,530,472 | Anderson | Mar 24, 1925 |
| 1,435,634 | Foxhall | Nov 14, 1922 |
| 1,086,609 | Nilson | Feb 10, 1914 |

SUMMARY OF THE INVENTION

The present invention provides a quick release clamp for lifting and handling of I beams and the like. A central purpose of this device is to facilitate such handling, resulting in conservation of labor, reduction in handling costs, and increased safety. The arrangement of the device is such that, while providing a secure and efficient grip on the beam during handling, fast release is readily accomplished.

The invention provides a dual purpose release line employed to either remove the clamp from an article, or to open it for application to a remote object. For example, the clamp may be applied from the ground to an elevated I beam by using this release line. This also permits release of the clamp from high level beams without the necessity for walking on the beam.

In prior practice, various stacking devices have been necessitated in order to permit off loading of I beams. The present device obviates the requirement for such devices by making it possible to unload the beams from a closely packed array.

Other and further objects and advantages of the invention will become apparent to those skilled in the art from a consideration of the following specification when read in conjunction with the annexed drawings.

BRIEF DESCRIPTION OF THE DRAWINGS

FIG. 1 is a perspective view showing a device hereof in a typical instance of use;

FIG. 2 is an enlarged side elevational view;

FIG. 3 is an end elevational view;

DESCRIPTION OF THE PREFERRED EMBODIMENTS

Figure 4A:
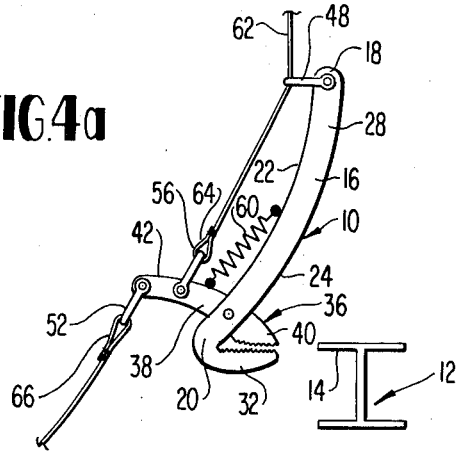
FIGS. 4*a* through 4*c* are side views of one form of the invention in use.

Referring to the drawings in more detail a lift clamp according to this invention is shown in FIGS. 1 through 4 and therein generally identified by reference numeral 10. The lift clamp, while possessing general utility in performing lifting and clamping functions, is particularly suited to handling of I beams 12 which have at least one projecting ledge 14.

A principal component of the clamp assembly 10 is an elongated main lift arm 16 which includes an upper end 18 and a lower end 20. The lift arm 16 is longitudinally curved from end to end in such manner that it is concave on its rear side 22 and convex on its forward side 24. The lower end section of the main lift arm is of substantially greater width than the upper section thereof, and an enlarged slot 26 is formed therein and extends from side to side. The arm also has lateral sides 28 and 30.

A fixed jaw member 32 is integrally joined to the lower end 20 of the main lift arm. The jaw member projects outwardly at an acute angle to the general extent of the main lift arm, and includes a toothed, straight gripping surface 34 also oriented at an acute angle to the convex forward side 24.

A movable jaw 36 comprises a curvalinear compression lever 38 having a proximal jaw end 40 and a distal remote end 42. The compression lever extends through the slot 26, and a pivot pin 44 extends through the lateral sides of the lift arm and through the slot and the compression lever. This permits limited pivotal movement of the compression lever within the slot. The proximal jaw end of the compression lever has an enlarged, toothed jaw member 46 thereon with teeth projecting in a convex fashion. The toothed jaw is pivotal with the compression lever to open and close alternative positions. In the closed position, the toothed jaw is closely proximate to the fixed jaw teeth.

A first shackle 48 of loop form is pivotally secured to the upper end 18 of the main lift arm by a through pin 50. A second opening 51 is formed in the arm for adjustable positioning of the shackle. A second loop type shackle 52 is pivotally secured to the distal remote end 42 of the compression lever by a pin 54, and a third shackle 56 is pivotally secured on a pin 58 intermediate the ends of the compression lever.

In a preferred form of the invention a compression coil spring 60 is secured to the compression lever and to the concave section 22 of the main lift arm. The spring exerts a constant bias tending to force the compression lever teeth toward the teeth of the fixed jaw. The spring is preferably of a readily removable type.

A whip wire 62 extends through the first shackle 48 and is connected to the third shackle 56 at a loop end 64 thereof. The opposite end of the whip wire (not shown) extends to a movable winch or other appropriate lift source. Secured to the second shackle 52 at an end loop 66 is a tag line 68 which normally hangs loosely.

The second opening 51 permits the shackle 48 to be moved downwardly to pull the whip wire closer to the shank when lifting wide beams. This tends to pull the shank toward the whip wire and cause the bill of the fixed jaw at the bottom to adjust the horizontal position of the beam.

Figure 4B:
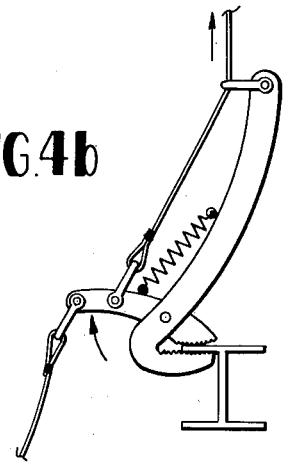
Figure 4C:
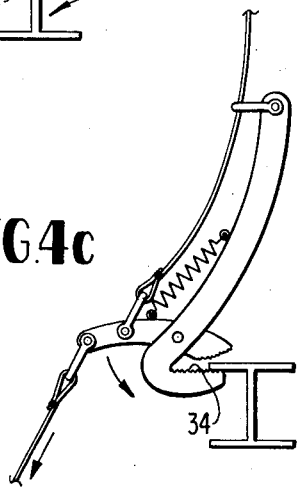
Figure 5A:
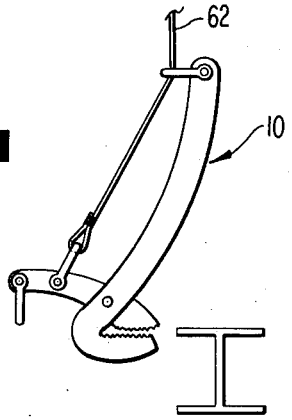
FIGS. 5*a* through 5*c* show use of a second embodiment.
Figure 5B:
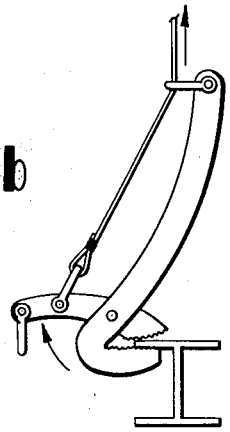
Figure 5C:
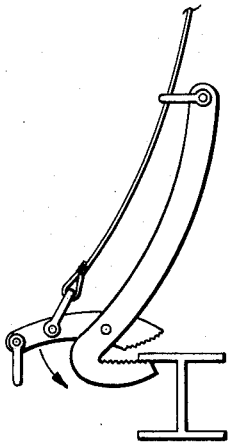

In use, the unit 10 is moved by the whip wire 62 to a position proximate to an I beam to be lifted. Force is then exerted on the tag line 68 to open the jaws whereafter the bottom jaw is positioned under the ledge 14. Pressure on the tag line is then released, and the spring brings the jaws to bear on the ledge. Moreover, once in position, as the force on the whip wire is increased, the pressure of the lever is also increased making disconnection of the teeth from the ledge impossible so long as the pressure on the whip wire is continued. When the beam has been moved to a desired location, pressure is released on the whip wire and again applied to the tag line to release the jaws. This sequence of operations is shown in FIGS. 4*a* through 4*c*. In FIGS. 5*a* through 5*c* it will be observed that both the spring 60 and the tag line 68 have been removed. In this form of utilization of the invention, the compression lever is manipulated solely by the whip wire 62. In such uses, the device is positioned on the ledge by permitting slack in the whip wire and, after being placed in position as in FIG. 5*b*, the application of upward force on the whip wire locks the compression lever in place. Upon completion of movement of the beam, shown in FIG. 5*c*, the whip wire is again slackened which causes the opening of the jaws.

I claim:

1. A lift clamp for handling of objects such as I beams which have at least one projecting ledge, the lift clamp comprising:

an elongated main lift arm having an upper end and a lower end;

the main lift arm being longitudinally curved, and being of increased width throughout its lower end;

the main lift arm having forward and rear sides and being curved in such manner that it is concave on its rear side and convex on its forward side;

the lower end having a slot formed therein extending from side to side;

the main lift arm having lateral sides;

a fixed jaw member integrally secured to the lower end and projecting from the lower end in the direction of the convex forward side, the fixed jaw including a toothed grip surface, said grip surface being oriented at an acute angle relative to the convex side;

a movable jaw comprising a curvalinear compression lever with a proximal jaw end and distal remote end;

the compression lever extending through the slot in the lower end of the main lift arm, and a pivot pin extending through the lateral sides of the main lift arm and through the compression lever;

the proximal jaw end of the compression lever having an enlarged toothed jaw member thereon with the teeth projecting in convex fashion, the arm being pivotal to a position whereat the toothed jaw member is closely adjacent the teeth of the fixed jaw;

a first shackle of loop form pivotally secured to the upper end of the main lift arm;

a second shackle of loop form pivotally secured to the distal remote end of the compression lever;

a third shackle of loop form pivotally secured to the compression lever intermediate its ends;

spring means between the compression lever and the main lift arm constantly biasing the movable jaw toward the fixed jaw;

a whip wire extending through the first shackle, connected to the third shackle, and secured to a lift source; and a tag line secured to the second shackle to open said jaws, whereby upon clamping of said jaws on the projecting ledge of the I beam, the I beam may be lifted or moved by manipulation of the whip wire to desired position and the clamp thereafter released by slacking of the whip wire and pulling of the tag line.

2. A lift clamp for handling of objects having at least one projecting ledge, the lift clamp comprising:

an elongated main lift arm having an upper end and a lower end;

a fixed jaw on the lower end of the main lift arm, the fixed jaw having a gripped surface;

a compression lever pivotally secured to the main lift arm, said compression lever having a proximal jaw, and being pivotal to a position whereat the proximal jaw thereof is closely adjacent the fixed jaw of the main lift arm;

a first shackle on the upper end of the main lift arm and second and third shackles on the compression lever;

a whip wire extending through the first shackle and secured to the third shackle on the compression lever; and a tag line secured to the second shackle on the compression lever whereby upon clamping of said jaws on said ledge the object may be moved or lifted by manipulation of the whip wire to desired position and the clamp thereafter released by slacking of the whip wire and pulling of the tag line.

3. The invention of claim 2, and:

spring means between the compression lever and the main lift arm.

4. The invention of claim 2, wherein:

the third shackle is secured pivotally to the compression lever intermediate its ends; and the tag line is secured on said second shackle to the compression lever at a location remote from the proximal jaw end thereof.

5. The invention of claim 4, wherein:

the main lift arm has a slot therein; and the compression lever extends through said slot.

* * * * *